US012302955B1

(12) United States Patent
Turnbull-Morgenthaler et al.

(10) Patent No.: US 12,302,955 B1
(45) Date of Patent: May 20, 2025

(54) COLLECTION OF BRAS

(71) Applicant: Mast Industries (Far East) Limited, Kowloon (HK)

(72) Inventors: Sophie Turnbull-Morgenthaler, Brighton (GB); Ursula Giovanna Todaro, Commack, NY (US); Yarden Gagnon, Brooklyn, NY (US)

(73) Assignee: Mast Industries (Far East) Limited, Kowloon Bay (HK)

( * ) Notice: Subject to any disclaimer, the term of this patent is extended or adjusted under 35 U.S.C. 154(b) by 0 days.

(21) Appl. No.: 18/633,803

(22) Filed: Apr. 12, 2024

(51) Int. Cl.
*A41C 3/00* (2006.01)

(52) U.S. Cl.
CPC ..... *A41C 3/0014* (2013.01)

(58) Field of Classification Search
CPC ..... A41C 3/0014
See application file for complete search history.

(56) References Cited

U.S. PATENT DOCUMENTS

| | | | |
|---|---|---|---|
| 3,873,403 | A | 3/1975 | Edelman |
| 4,776,916 | A | 10/1988 | Prunesti |
| 5,154,659 | A | 10/1992 | Gluckin |
| 5,916,829 | A | 6/1999 | Girard |
| 6,769,358 | B2 | 8/2004 | Jordan |
| 6,827,628 | B2 | 12/2004 | Kaye |
| 7,052,360 | B2 | 5/2006 | Lau |
| 7,128,635 | B1 | 10/2006 | Liu |
| 7,192,332 | B2 | 3/2007 | Liu |
| 7,240,371 | B2 | 7/2007 | Liu |
| 7,407,427 | B1 | 8/2008 | Liu |
| 7,422,508 | B2 | 9/2008 | Bentham |
| 7,591,707 | B2 | 9/2009 | Yu |

(Continued)

FOREIGN PATENT DOCUMENTS

| | | | |
|---|---|---|---|
| CN | 202112324 | U | 1/2012 |
| CN | 203087546 | U | 7/2013 |

(Continued)

OTHER PUBLICATIONS

Ceric, Paolo, "Net Series," published on website Behance at least as early as 2013, https://www.behance.net/gallery/8303967/Net-series, accessed Nov. 4, 2022.

(Continued)

*Primary Examiner* — Gloria M Hale
(74) *Attorney, Agent, or Firm* — Andrus Intellectual Property Law, LLP

(57) ABSTRACT

A collection of bras includes a first set providing a first level of support to breast tissue. Each bra in the first set includes a first inner layer, a first outer layer, and a first printed reinforcement layer positioned between the first inner and outer layers. The collection includes a second set providing a second level of support to breast tissue. Each bra in the second set includes a second inner layer, a second outer layer, and a second printed reinforcement layer positioned between the second inner and outer layers. A weight of the first inner layer and first outer layer is less than that of the second inner layer and second outer layer, an amount of printed material in the first printed reinforcement layer is less than that in the second printed reinforcement layer, and the first level of support is less than the second level of support.

20 Claims, 9 Drawing Sheets

(56) References Cited

U.S. PATENT DOCUMENTS

| | | | | |
|---|---|---|---|---|
| 7,833,082 | B2 | 11/2010 | Bugada | |
| 7,862,401 | B2 | 1/2011 | Watrin | |
| 8,128,456 | B2 | 3/2012 | Liu | |
| 8,128,457 | B2 | 3/2012 | Reinisch | |
| 8,221,188 | B2 | 7/2012 | Liu | |
| 8,262,432 | B2 | 9/2012 | Sokolowski | |
| 8,317,567 | B2 | 11/2012 | Watrin | |
| 8,388,406 | B2 | 3/2013 | Liu | |
| 8,480,452 | B2 | 7/2013 | Reinisch | |
| 8,551,278 | B2 | 10/2013 | Abbott | |
| 9,060,551 | B2 | 6/2015 | Nordstrom | |
| 9,192,198 | B2 | 11/2015 | Nordstrom | |
| 9,241,514 | B2 | 1/2016 | Shearer | |
| 9,332,789 | B2 | 5/2016 | Campbell | |
| 9,433,244 | B2 | 9/2016 | Zhang | |
| 9,456,638 | B2 | 10/2016 | Abbott | |
| 9,668,531 | B2 | 6/2017 | Nordstrom | |
| 9,717,289 | B1 | 8/2017 | Fooden | |
| 9,788,579 | B2 | 10/2017 | Miller | |
| 9,854,861 | B2 | 1/2018 | Covelli | |
| 9,883,702 | B2 | 2/2018 | Martinet | |
| 10,028,540 | B2 | 7/2018 | Shearer | |
| 10,051,896 | B2 | 8/2018 | Miller | |
| 10,104,917 | B2 | 10/2018 | Liao | |
| 10,104,925 | B2 | 10/2018 | Farmer | |
| 10,123,575 | B2 | 11/2018 | Funk-Danielson | |
| 10,143,252 | B2 | 12/2018 | Nordstrom | |
| 10,188,152 | B2 | 1/2019 | Stasey | |
| 10,231,492 | B1 * | 3/2019 | Bastug | A41C 3/10 |
| 10,244,801 | B2 | 4/2019 | Witek | |
| 10,368,591 | B2 | 8/2019 | Funk-Danielson | |
| 10,426,202 | B2 | 10/2019 | Wyatt | |
| 10,448,678 | B2 | 10/2019 | Randall | |
| 10,448,679 | B1 | 10/2019 | Roddis | |
| 10,638,800 | B2 | 5/2020 | Hoeven | |
| 10,640,896 | B2 | 5/2020 | Barnes | |
| 10,681,941 | B2 | 6/2020 | Miller | |
| 10,716,338 | B2 | 7/2020 | Witek | |
| 10,842,210 | B2 | 11/2020 | Nordstrom | |
| 10,993,483 | B2 | 5/2021 | Trangmar | |
| 11,058,155 | B2 | 7/2021 | Roddis | |
| 11,284,647 | B2 | 3/2022 | Blecha | |
| 11,312,808 | B2 | 4/2022 | Farmer | |
| 11,464,262 | B2 | 10/2022 | Miller | |
| 11,659,872 | B2 | 5/2023 | Hoeven | |
| 11,737,499 | B2 | 8/2023 | Miller | |
| 11,758,953 | B2 | 9/2023 | Witek | |
| 11,766,076 | B2 | 9/2023 | Cahan | |
| 11,771,144 | B1 * | 10/2023 | Vansia | A41C 3/0014 450/39 |
| 11,793,246 | B2 | 10/2023 | Trangmar | |
| 2002/0055317 | A1 | 5/2002 | Kopelowicz | |
| 2003/0092355 | A1 * | 5/2003 | Rabinowicz | A41C 5/00 450/1 |
| 2004/0029485 | A1 | 2/2004 | Pagliarulo | |
| 2005/0097658 | A1 | 5/2005 | Lyons | |
| 2005/0159078 | A1 | 7/2005 | Querquant | |
| 2005/0272345 | A1 | 12/2005 | Lau | |
| 2006/0141905 | A1 | 6/2006 | Lau | |
| 2006/0183849 | A1 | 8/2006 | Liu | |
| 2006/0183850 | A1 | 8/2006 | Liu | |
| 2006/0183851 | A1 | 8/2006 | Liu | |
| 2007/0026767 | A1 | 2/2007 | Scheininger | |
| 2007/0185003 | A1 | 8/2007 | Iavarone | |
| 2007/0264462 | A1 | 11/2007 | Covelli | |
| 2008/0004395 | A1 | 1/2008 | Covelli | |
| 2009/0047481 | A1 | 2/2009 | Welsch | |
| 2011/0083246 | A1 | 4/2011 | Vitarana | |
| 2017/0226691 | A1 * | 8/2017 | Farmer | B32B 7/05 |
| 2017/0342658 | A1 | 11/2017 | Kawamura | |
| 2019/0174841 | A1 * | 6/2019 | Bastug | A41C 3/0007 |
| 2019/0216140 | A1 | 7/2019 | Turlan-Van Der Hoven | |
| 2019/0284325 | A1 | 9/2019 | Farmer | |
| 2020/0397064 | A1 | 12/2020 | Liu | |
| 2021/0172114 | A1 | 6/2021 | Farmer | |
| 2022/0053841 | A1 | 2/2022 | Roddis | |
| 2022/0095704 | A1 * | 3/2022 | Salemeh | B33Y 10/00 |
| 2022/0211120 | A1 | 7/2022 | Liu | |
| 2022/0312874 | A1 | 10/2022 | Nordstrom | |
| 2022/0400780 | A1 | 12/2022 | Liu | |
| 2023/0015684 | A1 * | 1/2023 | Stevens | A41C 3/0014 |
| 2023/0077251 | A1 | 3/2023 | Farmer | |
| 2023/0088813 | A1 | 3/2023 | Maduranga | |
| 2023/0363468 | A1 * | 11/2023 | Abbott | B32B 5/26 |
| 2023/0389621 | A1 | 12/2023 | Premasiri | |
| 2024/0016237 | A1 | 1/2024 | Trangmar | |
| 2024/0284995 | A1 * | 8/2024 | Wu | A41C 5/005 |

FOREIGN PATENT DOCUMENTS

| | | | |
|---|---|---|---|
| CN | 108201190 | A | 6/2018 |
| CN | 207692981 | U | 8/2018 |
| CN | 112006343 | A | 12/2020 |
| CN | 114098178 | A | 3/2022 |
| CN | 217446735 | U | 9/2022 |
| CN | 115969107 | A | 4/2023 |
| CN | 220308464 | U | 1/2024 |
| DE | 19942996 | A1 | 3/2001 |
| DE | 202018103990 | U1 | 7/2018 |
| EP | 3238556 | A1 | 11/2017 |
| EP | 4051040 | A1 | 9/2022 |
| GB | 2503280 | A | 12/2013 |
| JP | 2019011545 | A | 1/2019 |
| KR | 200439066 | Y1 | 3/2008 |
| KR | 20190000347 | U | 2/2019 |
| WO | 2012143398 | A1 | 10/2012 |
| WO | 2020073163 | A1 | 4/2020 |
| WO | 2020243924 | A1 | 12/2020 |
| WO | 2021031097 | A1 | 2/2021 |
| WO | 2021096430 | A1 | 5/2021 |
| WO | 2021173081 | A1 | 9/2021 |
| WO | 2021178372 | A1 | 9/2021 |
| WO | 2022086453 | A1 | 4/2022 |
| WO | 2022147738 | A1 | 7/2022 |
| WO | 2022155761 | A1 | 7/2022 |

OTHER PUBLICATIONS

LYCRA, "Why choose LYCRA FitSense Technology?", webpage, admitted prior art, https://www.lycra.com/en/business/search-technologies/lycra-fitsense-technology, accessed Nov. 4, 2022.

The LYCRA Company, "Triumph is using LYCRA® FitSense™ technology to bring lightweight, targeted support to its SS20 Summer Sheer collection," web article, Apr. 14, 2020, available at https://www.lycra.com.cn/en/business/news/triumph-targeted-fit-leading-lingerie-brand-adopts-lycra-fitsense-technology.

The LYCRA Company, "LYCRA FitSense technology Processing information for screen printing," technical document, Mar. 10, 2021.

The LYCRA Company, "LYCRA Fitsense Technology Intimates and Shapewear," lookbook, 2022.

* cited by examiner

COLLECTION OF BRAS

FIELD

The present disclosure relates to bras, and more specifically to a collection of bras that provide different levels of support to a wearer's breasts.

BACKGROUND

U.S. Pat. No. 8,262,432 discloses a lightweight enhanced modesty sports bra. The sports bra comprises an interior liner layer having two faces and an exterior shell layer having two faces and a printed obscuration pattern in between the interior liner layer and the exterior shell layer. The interior liner layer and the exterior shell layer with the printed obscuration pattern are assembled in a way that provides modesty and the printed pattern is not visible from the outside. An optional layer called the intermediate liner layer may be placed in between the exterior shell layer and the interior liner layer.

U.S. Pat. No. 9,456,638 discloses a breast cup for a brassiere, a brassiere, and a method of making the breast cup. The breast cup includes a molded body having an inner surface, an outer surface and an apex. A layer of flock is adhered to the molded body at a location corresponding with the apex in order to provide increased modesty for the breast cup.

U.S. Pat. No. 9,788,579 discloses a brassiere that includes a back portion and a front portion coupled to the back portion at side areas. Straps are coupled to the front portion and the back portion. Cup panels are provided on the front portion and extend to the straps. Each cup panel includes a perimeter cup region and a central cup region located on the front portion and a strap region located on one of the straps. The perimeter cup region and the strap region having a greater elastic modulus than the central cup region. In at least one embodiment, each cup panel includes a first layer and a second layer. The second layer is provided by a polymer sheet including a plurality of openings formed in the polymer sheet. The arrangement of the openings on the polymer sheet contributes to the elastic modulus in the central cup region, the perimeter cup region, and the strap region of the cup panel.

U.S. Pat. No. 9,883,702, which is incorporated herein by reference in its entirety, discloses a portion of a bra, such as a bra wing or bra cup, that includes a double-faced fabric made with a polyurethane-based elastomer yarn. A silicone pattern is printed on a first face of the fabric, and at least partially penetrates the first face. In a first zone on the first face of the fabric, the printed silicone pattern has a first surface density, and in a second zone it has a second surface density. The first surface density imparts a first elastic modulus to the fabric in the first zone, while the second surface density imparts a second elastic modulus to the fabric in the second zone that is different than the first elastic modulus. A plurality of zones can be provided in order to provide a smoothing and/or support effect to the portion of the bra.

U.S. Pat. No. 11,284,647 discloses a breast support garment for use in active environments, where the wearer of such garment is engaged in an activity that results in accelerating movements. In some preferred embodiments, these garments may be athletic or sports bras that redirect momentum related to a wearer's accelerating movements, for example, during exercise.

U.S. Pat. Nos. 11,771,144 and 12,096,806 and U.S. patent application Ser. No. 18/815,395, filed Aug. 26, 2024, which are incorporated herein by reference in their entireties, disclose a bra cup for a bra that includes an inner layer of material configured to face a wearer's breast when the bra is worn and an outer layer of material configured to face away from the wearer when the bra is worn. An outer face of the inner layer of material is adjacent an inner face of the outer layer of material. A thin polymer web is disposed on the outer face of the inner layer of material. A bra including the bra cup and a method of manufacturing the bra cup are also disclosed.

U.S. Patent Publication No. 2022/0400780 discloses an article of clothing that includes a first fabric layer having an inner surface and an outer surface. The article of clothing also includes a second fabric layer having an inner surface and an outer surface. The article of clothing further includes a silicone layer embedded with at least one of the inner surface of the first fabric layer and the inner surface of the second fabric layer, and thereby joining the first fabric layer and the second fabric layer. The article of clothing includes a first zone of a first thickness and a second zone of a second thickness. The first thickness is greater than the second thickness, and the first zone is disposed along an edge of the article of clothing while the second zone is disposed further away from the edge than the first zone.

International Application Publication No. WO 2023/173231 A1 discloses examples of a garment with a support structure. The garment includes a front portion, a back portion, and first and second side portions. The front portion covers a portion of a wearer's chest and includes a lower edge, an upper edge portion, and first and second sides. The back portion covers a portion of the wearer's back, and includes a lower edge, an upper edge portion, and first and second sides. The first and second side portions extend between the front and back portions, and include lower edges. The first and second side portions include two or more stretching module zones that have a low stretching module zone in proximity to the arm openings of the garment and a lower edge stretching module zone in proximity to the first and second lower edges.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a collection of bras comprises a first set of bras configured to provide a first level of support to breast tissue. Each of the bras in the first set of bras includes a first inner layer, a first outer layer, and a first printed reinforcement layer positioned between the first inner layer and the first outer layer. The collection of bras further comprises a second set of bras configured to provide a second level of support to breast tissue. Each of the bras in the second set of bras includes a second inner layer, a second outer layer, and a second printed reinforcement layer positioned between the second inner layer and the second outer layer. A material weight of the first inner layer and the first outer layer is less than a material weight of the second inner layer and the second outer layer, an amount of printed material comprising the first printed reinforcement layer is less than an amount of printed material comprising the second printed reinforcement layer, and the first level of support is less than the second level of support.

According to one example, the first inner layer, the first outer layer, the second inner layer, and the second outer layer each comprise a microfiber material.

According to one example, the first printed reinforcement layer and the second printed reinforcement layer each comprise a silicone material.

According to one example, the material weight of the first inner layer and the first outer layer is about 150 grams per square meter, and the material weight of the second inner layer and the second outer layer is about 190 grams per square meter.

According to one example, the first set of bras comprises bras having a first set of bra cup sizes, the second set of bras comprises bras having a second set of bra cup sizes, and the first set of bra cup sizes is different from the second set of bra cup sizes.

According to one example, the collection of bras further comprises a third set of bras configured to provide a third level of support to breast tissue. Each of the bras in the third set of bras comprises a third inner layer, a third outer layer, and a third printed reinforcement layer positioned between the third inner layer and the third outer layer. The third level of support is greater than the first level of support and the second level of support.

According to one example, a material weight of the third inner layer and the third outer layer is greater than a material weight of the first inner layer, the first outer layer, the second inner layer, and the second outer layer.

According to one example, an amount of printed material comprising the third printed reinforcement layer is greater than an amount of printed material comprising the first printed reinforcement layer.

According to one example, an amount of printed material comprising the third printed reinforcement layer is less than an amount of printed material comprising the second printed reinforcement layer.

According to one example, the material weight of the first inner layer and the first outer layer is about 150 grams per square meter, the material weight of the second inner layer and the second outer layer is about 190 grams per square meter, and the material weight of the third inner layer and the third outer layer is about 220 grams per square meter.

According to one example, the first set of bras comprises bras having a first set of bra cup sizes, the second set of bras comprises bras having a second set of bra cup sizes, the third set of bras comprises bras having a third set of bra cup sizes, and the third set of bra cup sizes is different from at least one of the first set of bra cup sizes and the second set of bra cup sizes.

According to another example of the present disclosure, a collection of undergarments is provided. The collection of undergarments comprises a plurality of sets of undergarments, wherein each set in the plurality of sets is configured to provide a corresponding level of support to a wearer's body, and wherein each undergarment in the plurality of sets comprises an inner layer, an outer layer, and a printed reinforcement layer bonding the inner layer to the outer layer. At least one of the following conditions is satisfied in the collection of undergarments: a material weight of the inner layer and the outer layer of each undergarment in one set of the plurality of sets is different from a material weight of the inner layer and the outer layer of each undergarment in every other set in the plurality of sets; and an amount of printed material comprising the printed reinforcement layer of each undergarment in one set of the plurality of sets is different from an amount of printed material comprising the printed reinforcement layer of each undergarment in every other set in the plurality of sets.

According to one example, the inner layer and the outer layer each comprise a microfiber material.

According to one example, the printed reinforcement layer comprises a silicone material.

According to one example, each undergarment in the plurality of sets is a bra.

According to one example, each bra comprises a pair of bra cup regions, and printed material of the printed reinforcement layer is located between the pair of bra cup regions.

According to one example, each bra comprises a pair of bra cup regions, and printed material of the printed reinforcement layer is located underneath the pair of bra cup regions.

According to one example, each bra comprises a pair of straps, and printed material of the printed reinforcement layer is located within at least a portion of each strap in the pair of straps.

According to one example, the plurality of sets of undergarments comprises a first set of bras associated with a first set of bra cup sizes and a second set of bras associated with a second set of bra cup sizes, and the first set of bra cup sizes is different from the second set of bra cup sizes.

According to one example, a difference between the material weight of the inner layer and the outer layer of each bra in the first set of bras and the material weight of the inner layer and the outer layer of each bra in the second set of bras is at least 30 grams per square meter.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
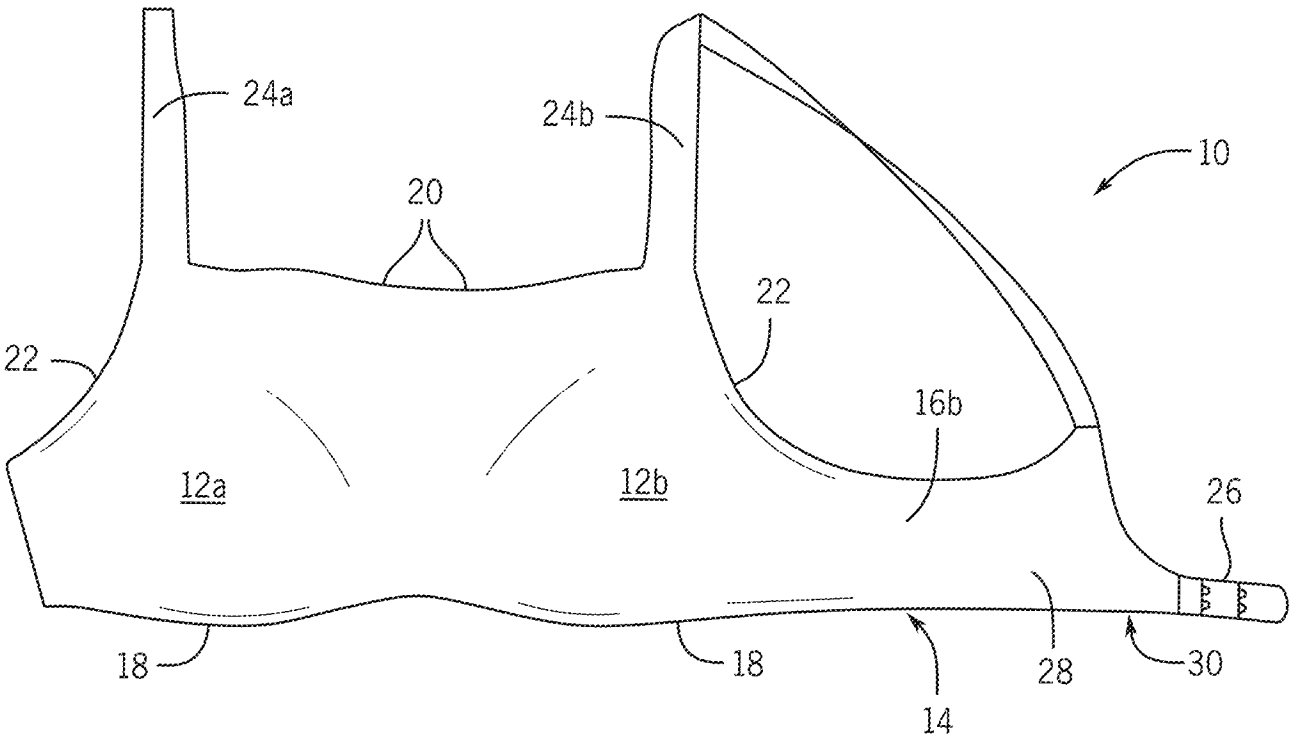
FIG. 1 illustrates an outer face of an exemplary bra in a collection of bras according to the present disclosure.

Before any embodiments of the invention are explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "bottom," "front," "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another. Unless otherwise specified or limited, the word "about" means ±10%. The phrase "at least about" means greater than or equal to the value recited ±10%.

Reference will be made herein to the "inner face" of a layer or to the "outer face" of a layer. The inner face is the surface that faces toward and touches a wearer's skin when the bra is worn as intended. The outer face is the surface that faces outwardly away from the wearer when the bra is worn as intended.

Bra cup size is defined in various ways across different styles, brands, and/or manufacturers. In general, bra cup size is related to and determined from bra band size. In one example, band size is measured around a wearer's torso, with a tape measure across her shoulder blades in the back and draped across the top of her breasts in the front. The measurement is directly translated to band size if even, or rounded up to the next even number if odd. In another example, band size is measured around the circumference of the wearer's torso just below her breasts. The measurement is directly translated to band size if even, or rounded up to the next even number if odd. In still another example, band size is determined by measuring the circumference of the wearer's torso just below her breasts and adding 4 inches (about 10.2 cm) if the measurement is even, or 5 inches (about 12.7 cm) if the measurement is odd, to arrive at band size. In any example for determining band size, cup size is then based on a difference between (a) a measurement around the fullest part of the wearer's bust and (b) her band size. To measure the fullest part of her bust, the measuring tape is wrapped around the circumference of her torso, parallel to the floor, over the fullest part of her breasts. A difference between the bust size measurement and the band size (regardless of how it was determined) is then correlated to a cup size. In most cases, an "AA" cup will fit a wearer with no difference between bust and band size, an "A" cup will fit a wearer with 1 inch (about 2.5 cm) of difference between bust and band size; a "B" cup will fit a wearer with 2 inches (about 5.1 cm) of difference between bust and band size; a "C" cup will fit a wearer with 3 inches (about 7.6 cm) of difference between bust and band size; etc.

Note that internationally, the letters AA, A, B, C, D, etc. are not universally used to denote cup size. For instance, by way of non-limiting example, cup size DD is sometimes referred to as E. Cup size DDD is sometimes referred to as F, and sometimes referred to as E. The present disclosure will henceforward describe bra sizing in terms of inches and A, B, C, D, etc. according to United States sizing standards. However, it should be understood that the present disclosure and claims apply equally to metric measurements and international variations on band and cup sizing. Further, style (e.g., sport versus lingerie, demi versus balconette, padded versus unlined), brand, and manufacturer can all affect bra size.

The present inventors have recognized that bust and band size tends to directly correlate with the level of support provided by the bra to a wearer's breasts: smaller bust and band sizes tend to provide little support, while larger sizes tend to provide much greater support. In the context of the present application, "support" refers to structural elements of the bra or undergarment that provide a lifting force to the wearer's body in opposition to gravity. For example, as described in further detail below, fabricating the bra out of thicker fabric and incorporating other support elements (e.g., underwires or other supports that stiffen the bra, wider straps) can increase the amount of support provided to a wearer's body.

The present inventors have further recognized that bust and band size does not always correspond to a wearer's desired level of support. For example, a wearer may desire a lower level of support for bras worn as loungewear or during sleep and a higher level of support for day to day or physically intensive activities, regardless of bust size. In addition, the composition of the wearer's breast tissue may also contribute to a desired level of support. For example, wearers having soft to medium breast tissue may desire a higher level of support than wearers having firm or augmented breast tissue. The present inventors have therefore devised a collection of bras utilizing discrete levels of fabric weight for the microfiber fabric forming the inner and outer layers of the bra, as well as discrete levels of deposited silicone to form structural supports between the inner and outer layers of the bra. Each of the discrete levels is provided in the collection in a variety of sizes, such that wearers having any bust and band size may select from the collection to achieve a customized fit.

FIG. 1 illustrates exemplary bra 10 in a collection of bras according to the present disclosure. FIG. 1 shows an outer face of the bra 10 (i.e., what would be seen when the bra 10 is worn by a wearer) having an outer layer 28. An inner layer 30 (on the opposite face of the bra 10 from that shown here) may be positioned opposite the outer layer 28 and may be substantially the same size and shape as the outer layer 28. In one example, the grain of the inner layer 30 is perpendicular to the grain of the outer layer 28. The bra 10 includes a pair of bra cup regions 12*a*, 12*b*. In some exemplary embodiments, and as described in further detail below, the bra cup regions 12*a*, 12*b* may be configured to receive and retain removable foam pads, also known as "cookies." The bra 10 also includes a chest band 14 configured to encircle and lay against a wearer's ribcage. The chest band 14 comprises a wing 16*b*. Although only one wing 16*b* is shown in FIG. 1, those having ordinary skill in the art would understand that another wing 16*a* extends from the other bra cup region 12*a*.

Each bra cup region 12*a*, 12*b* has a curved or straight bottom edge 18, a curved or straight neckline edge 20, and an underarm edge 22. The bra 10 also includes straps 24*a*, 24*b*, an eye closure part 26, and a hook closure part (not shown, but well known in the art) for engagement with the eye closure part 26. In an exemplary embodiment, the bra 10 may be constructed by forming the bra cup regions 12*a*, 12*b*, the wings 16*a*, 16*b*, and the straps 24*a*, 24*b* out of a pair of single pieces of fabric comprising the outer layer 28 and the inner layer 30. The outer and inner layers 28, 30 can be subsequently bonded to each other via a printed reinforcement layer that is generally silicone, described in further detail below with reference to FIGS. 2A-4B. In other exemplary embodiments, the bra cup regions 12*a*, 12*b*, the wings 16*a*, 16*b*, and/or the straps 24*a*, 24*b* may be formed from multiple pieces of fabric. For example, only the bra cup regions 12*a*, 12*b* and the wings 16*a*, 16*b* could be formed out of a pair of single pieces of fabric comprising the outer layer 28 and the inner layer 30. The straps 24*a*, 24*b* could be fabricated as separate pieces that are detachable from the main body portion comprising the bra cup regions 12*a*, 12*b* and the wings 16*a*, 16*b*, as is common in bandeau-style bras. In other examples, the straps 24*a*, 24*b* are formed of separate pieces of fabric but are not removable from the main body of the bra 10. In still other examples, the bra cup region 12*a*, 12*b* are formed out of a pair of single pieces of fabric comprising the outer layer 28 and the inner layer 30, while the wings 16*a*, 16*b* are each formed of separate pairs of single pieces of fabric comprising the outer layer 28 and the inner layer 30. In still other examples, the outer layer 28 and the inner layer 30 of the bra cup regions 12*a*, 12*b*, the wings 16*a*, 16*b*, and/or the straps 24*a*, 24*b* are formed from a single piece of fabric, which is folded over along the bottom edge 18.

As is known, the hook closure part (not shown) can be connected to the eye closure part 26 to secure the distal ends of the wings 16*a*, 16*b* together and thus to secure the chest band 14 around the wearer's ribcage. In other examples, the bra 10 is strapless and/or has stretchy wings 16*a*, 16*b* that allow a wearer to put on and take off the bra 10 by pulling it over her head. In still another example, the bra 10 is a front-close bra, with one back band extending from the outer edge of one bra cup region 12*a* to the outer edge of the other bra cup region 12*b* and a center-front closure between the two bra cup regions 12*a*, 12*b*. Various other styles and constructions of bras are contemplated within the scope of the present disclosure.

In an exemplary embodiment, each of the inner layer 30 and the outer layer 28 may be fabricated from a microfiber fabric exhibiting stretch characteristics in 360 degrees. The weight of the microfiber fabric depends on the level of support intended to be provided by the bra. Higher fabric weights apply a greater amount of support to a wearer. For example, in an exemplary embodiment, a bra providing level 1 support to a wearer's breasts may include outer and inner layers 28, 30 fabricated from microfiber material having a material weight of about 150 grams per square meter. A bra providing level 2 support to a wearer's breasts may include outer and inner layers 28, 30 fabricated from microfiber material having a material weight of about 190 grams per square meter. A bra providing level 3 support to a wearer's breasts may include outer and inner layers 28, 30 fabricated from microfiber material having a material weight of about 220 grams per square meter. In other examples, the fabric of the outer and inner layers 28, 30 can be other synthetic blends, cotton, lace, etc. depending on the desired aesthetic, level of support, and skin feel. The fabric weights provided above are merely exemplary, and, for example, may vary if the fabric is not microfiber, but instead cotton, lace, or sheer. Note that the outer and inner layers 28, 30 need not be the same fabrics, but could be different fabrics from one another. In examples in which a lace or other type of textured fabric is used as the outer layer 28, the lace or textured fabric may be bonded to a smooth fabric, and the reinforcement layer is sandwiched between the additional smooth fabric and the inner layer 30.

Figure 2A:
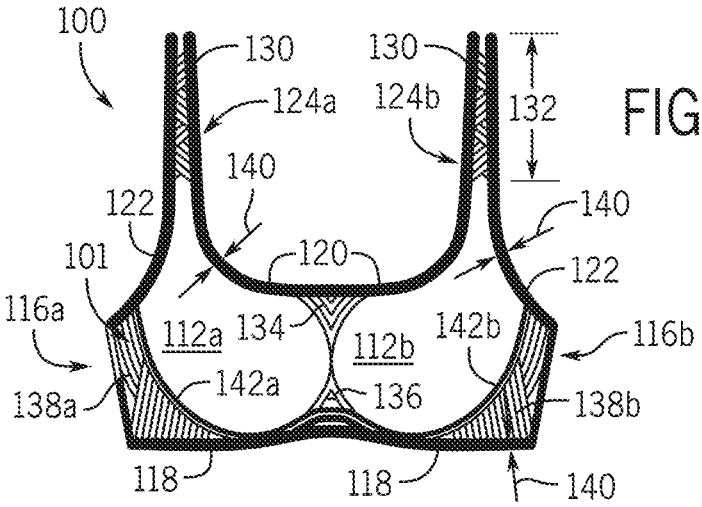
FIGS. 2A and 2B illustrate exemplary printed reinforcement layers on a front panel and a wing, respectively, providing a first level of support for a set of bras in the collection.
Figure 2B:
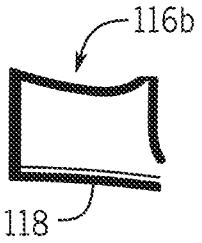
Figure 3A:
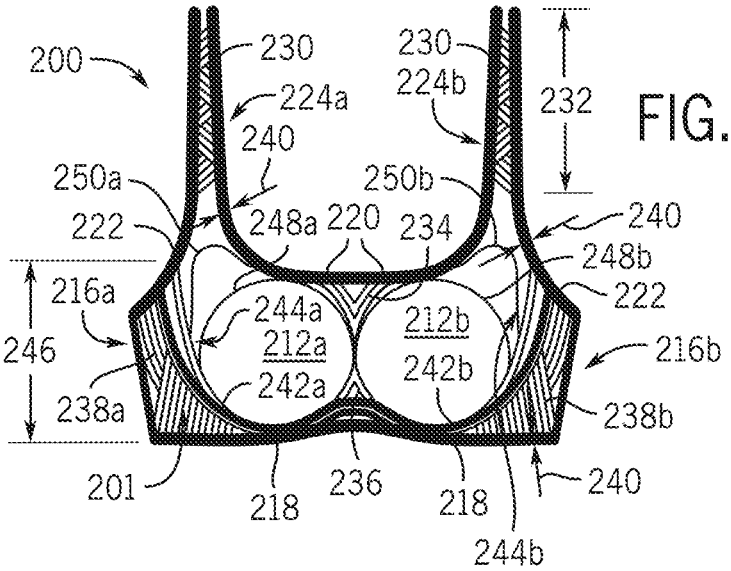
FIGS. 3A and 3B illustrate exemplary printed reinforcement layers on a front panel and a wing, respectively, providing a second level of support for a set of bras in the collection.
Figure 3B:
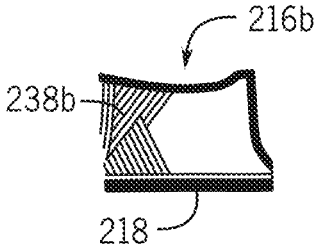
Figure 4A:
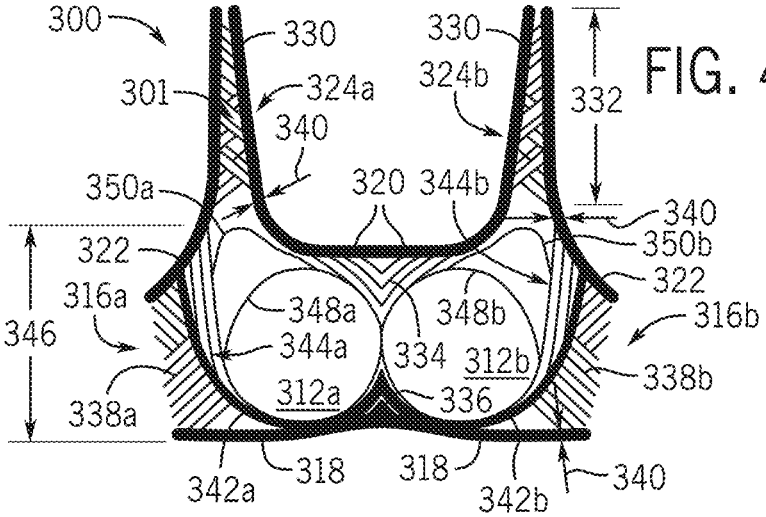
FIGS. 4A and 4B illustrate exemplary printed reinforcement layers on a front panel and a wing, respectively, providing a third level of support for a set of bras in the collection.
Figure 4B:
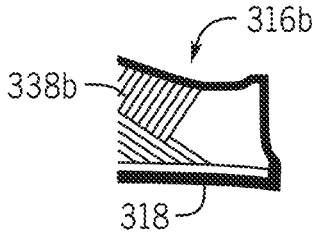

Referring now to FIGS. 2A-4B, several exemplary bras 100, 200, 300 having printed reinforcement layers 101, 201, 301 corresponding to three different levels of support are shown. Bra 100 of FIGS. 2A and 2B depicts a printed reinforcement layer 101 providing level 1 support to a wearer's breasts, bra 200 of FIGS. 3A and 3B depicts a printed reinforcement layer 201 providing level 2 support to a wearer's breasts, and bra 300 of FIGS. 4A and 4B depicts a printed reinforcement layer 301 providing level 3 support to a wearer's breasts. Each of the bras 100, 200, 300 corresponding to levels 1-3 may be provided in a variety of sizes corresponding to a variety of bust and band sizes (see FIG. 5 below).

FIGS. 2A-4B specifically depict exemplary patterns for the printed reinforcement layers 101, 201, 301 that may be printed directly on either the inner layer 30 or the outer layer 28. As contemplated herein, the printed reinforcement layers 101, 201, 301 are applied to either the outer face (i.e., non-skin side) of the inner layer 30 or to the inner face (facing the inner layer 30) of the outer layer 28 such that the printed reinforcement layer is sandwiched between the outer and inner layers 28, 30. FIGS. 2A, 3A, and 4A specifically depict printed reinforcement layers that may be printed on the bra cup regions, straps, cradle, and underarm regions. FIGS. 2B, 3B, and 4B specifically depict printed reinforcement layers that may be printed on the portions of the wings 116*b*, 216*b*, 316*b*, that would extend to a wearer's back when worn. It should be understood that the wings 116*a*, 216*a*, 316*a* would be mirror images of the wings 116*b*, 216*b*, 316*b* shown and described here. In an exemplary embodiment, the printed reinforcement layers 101, 201, 301 could be silicone. In other examples, the printed reinforcement layers could be one or more polyurethanes, one or more acrylics, a D58 aqueous dispersion such as that described in U.S. Pat. No. 11,312,808 and U.S. Publication No. 2021/0172114 and sold by LYCRA® under the trademark FIT-SENSE™, or other resins. In some examples, the outer and inner layers 28, 30 may be adhered together in the areas where there is no printed reinforcement layer, such as by application of a conventional spray adhesive. In one example, the reinforcement layer is applied to the outer face of the inner layer 30 or to the inner face of the outer layer 28 by screen printing. The non-printed layer is then placed adjacent the printed face of the printed layer. In another example, the printed layer may be printed with an extra reinforcement layer, such as a plurality of dots or other shapes, in a sling area of the bra. This extra reinforcement layer may be cured before the exemplary reinforcement layers shown in the figures herein are printed onto the fabric. After the exemplary reinforcement layers are printed, the non-printed layer is then placed adjacent the printed face of the printed layer. In either example, the two layers are next sent through a roller press to secure the bond. The composite panel is then cured with a dryer. After curing, the front panel may be molded to form breast cup areas. The wings can be prepared in a similar manner, and once the front panel and wings are both prepared, they can be bonded and/or stitched together.

The printed reinforcement layers 101, 201, 301 are shown to be provided in various locations on the bras 100, 200, 300. In an exemplary embodiment, strap reinforcements 130, 230, 330 may be printed within the straps of the bras (i.e., 124*a*, 124*b* of FIG. 2A; 224*a*, 224*b* of FIG. 3A; 324*a*, 324*b* of FIG. 4A.). Underbust reinforcements 142*a*, 142*b* may be provided at the lower and outer edges of cups 112*a*, 112*b*, respectively; underbust reinforcements 242*a*, 242*b* may be provided at the lower and outer edges of cup regions 212*a*, 212*b*, respectively; and underbust reinforcements 342*a*, 342*b* may be provided at the lower and outer edges of cup regions 312*a*, 312*b*, respectively. The underbust reinforcements 142*a*, 142*b*, 242*a*, 242*b*, 342*a*, 342*b* work to support the wearer's breasts against the force of gravity, serving the function of a traditional underwire. Upper and lower middle reinforcements 134, 136, 234, 236, 334, 336 may be printed between the cup regions (i.e., between 112*a* and 112*b* of FIG. 2A; between 212*a* and 212*b* of FIG. 3A, between 312*a* and 312*b* of FIG. 4A), and wing reinforcements 138*a*, 138*b*, 238*a*, 238*b*, 338*a*, 338*b* may be printed on at least a portion of the wings (i.e., 116*a*, 116*b* of FIGS. 2A and 2B; 216*a*, 216*b* of FIGS. 3A and 3B; 316*a*, 316*b* of FIGS. 4A and 4B). As shown, the surface area consumed by the printed reinforcement material for the upper and lower middle reinforcements 134, 136 in the level 1 bra is less than the surface area of upper and lower middle reinforcements 234, 236 of the level 2 bra, which is less than the surface area of upper and lower middle reinforcements 334, 336 of the level 3 bra. A similar pattern is shown in FIGS. 2B, 3B, and 4B in the wings 116*b*, 216*b*, and 316*b*: the level 1 bra contains no reinforcements that are positioned on a wearer's back when worn, the level 2 bra features a smaller surface area that is consumed by the wing reinforcements 238*b*, and the level 3 bra features a larger surface area that is consumed by the wing reinforcements 338*b*. In addition, perimeter reinforcements are shown to be included along the bottom edges 118, 218, 318, neckline edges 120, 220, 320 and underarm edges 122, 222, 322. The perimeter reinforcements are shown to have generally consistent thicknesses 140, 240, 340, and may further function to ensure the outer and inner layers 28, 30 are properly adhered to each other.

Each of the strap reinforcements 130, 230, 330, upper and lower middle reinforcements 134, 136, 234, 236, 334, 336, and wing reinforcements 138*a*, 138*b*, 238*a*, 238*b*, 338*a*, 338*b* is shown to include multiple sets of unbroken lines of reinforcement material that are generally parallel to each other. Such patterns are merely exemplary, and other reinforcement material patterns (e.g., cross-hatch, grid, dots, dashes, lace-like patterns, swirls, curved lines) are contemplated within the scope of the present disclosure.

In some examples, slits may be provided in the inner layer 30 to allow for insertion of removable pads 248*a*, 248*b* into pockets 250*a*, 250*b* (FIG. 3A) and removable pads 348*a*, 348*b* into pockets 350*a*, 350*b* (FIG. 4A). Pockets for insertion of removable pads may also be provided in the bra 100 of FIG. 2A in a similar manner. The pockets are formed between the inner layer 30 and the outer layer 28, where the outer and inner layers 28, 30 are not adhered together by the reinforcement layer.

Variations in the application of the reinforcement material between the level 1 (see FIGS. 2A and 2B), level 2 (see FIGS. 3A and 3B) and level 3 (see FIGS. 4A and 4B) bras result in differing levels of support provided to a wearer's breasts. For example, the length 132 of the strap reinforcements 130 of the level 1 bra is shorter than the length 232 of the strap reinforcements 230 of the level 2 bra, which in turn is shorter than the length 332 of the strap reinforcements 330 of the level 3 bra. Increasing the length of the strap reinforcements decreases the amount that the straps can stretch due to forces exerted by the wearer's breasts on the straps in the direction of gravity. In addition, as shown in levels 2 and 3, the cup regions 212*a*, 212*b*, 312*a*, 312*b* may further include cup reinforcements 244*a*, 244*b*, 344*a*, 344*b* that extend from the bottom edges 218, 318 to the underarm edges 222, 322. The length 246 of the cup reinforcements 244*a*, 244*b* as measured from the bottom edge 218 in the level 2 bra is shown to be shorter than the length 346 of the cup reinforcements 344*a*, 344*b* as measured from the bottom edge 318 of the level 3 bra. This is because the longer the cup reinforcements extend, the less that the cup regions 212*a*, 212*b*, 312*a*, 312*b* can stretch due to forces exerted by the wearer's breasts on the cup regions in the direction of gravity.

Figure 5:
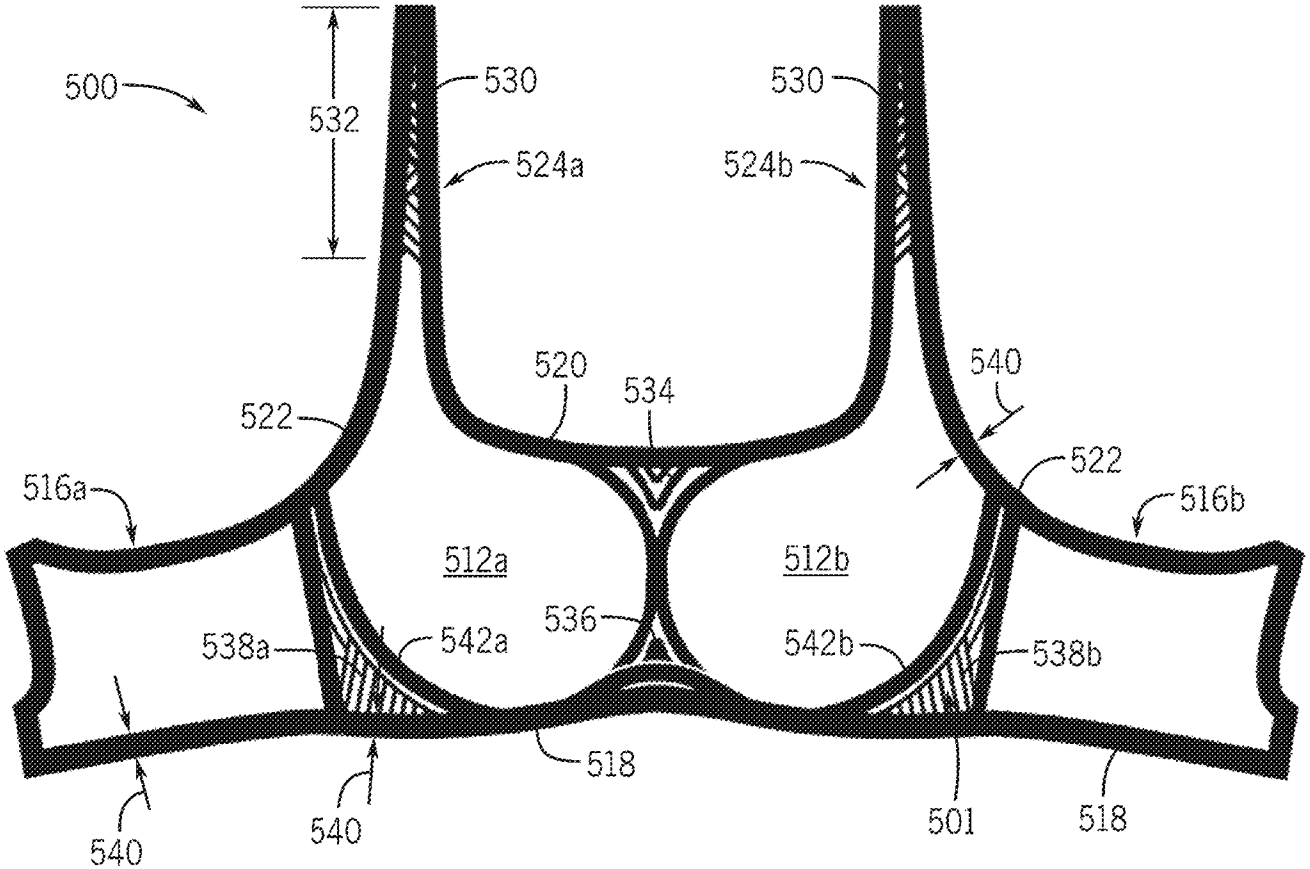
FIG. 5 illustrates an exemplary printed reinforcement layer for another set of bras having a first level of support.
Figure 6:
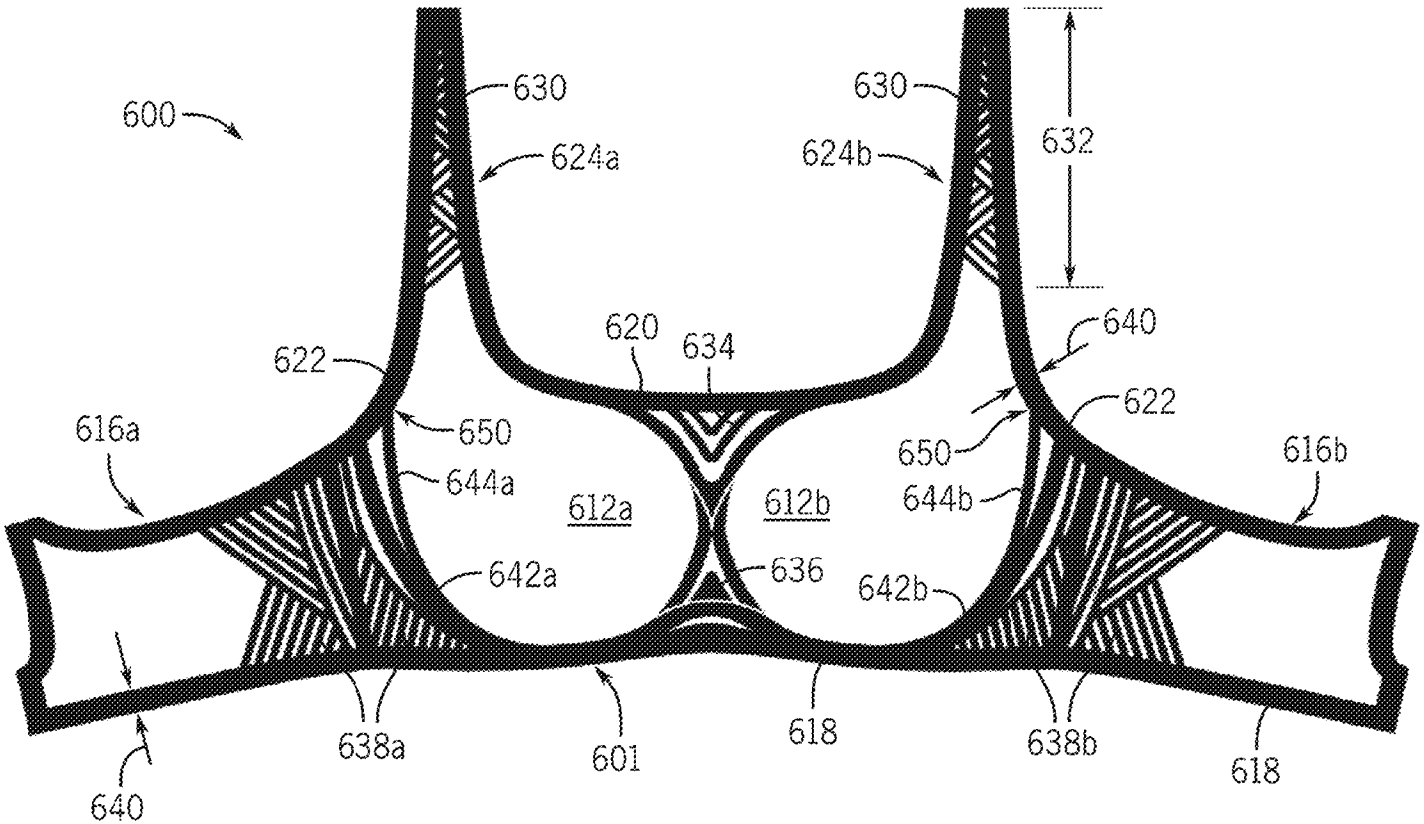
FIG. 6 illustrates an exemplary printed reinforcement layer for another set of bras having a second level of support.
Figure 7:
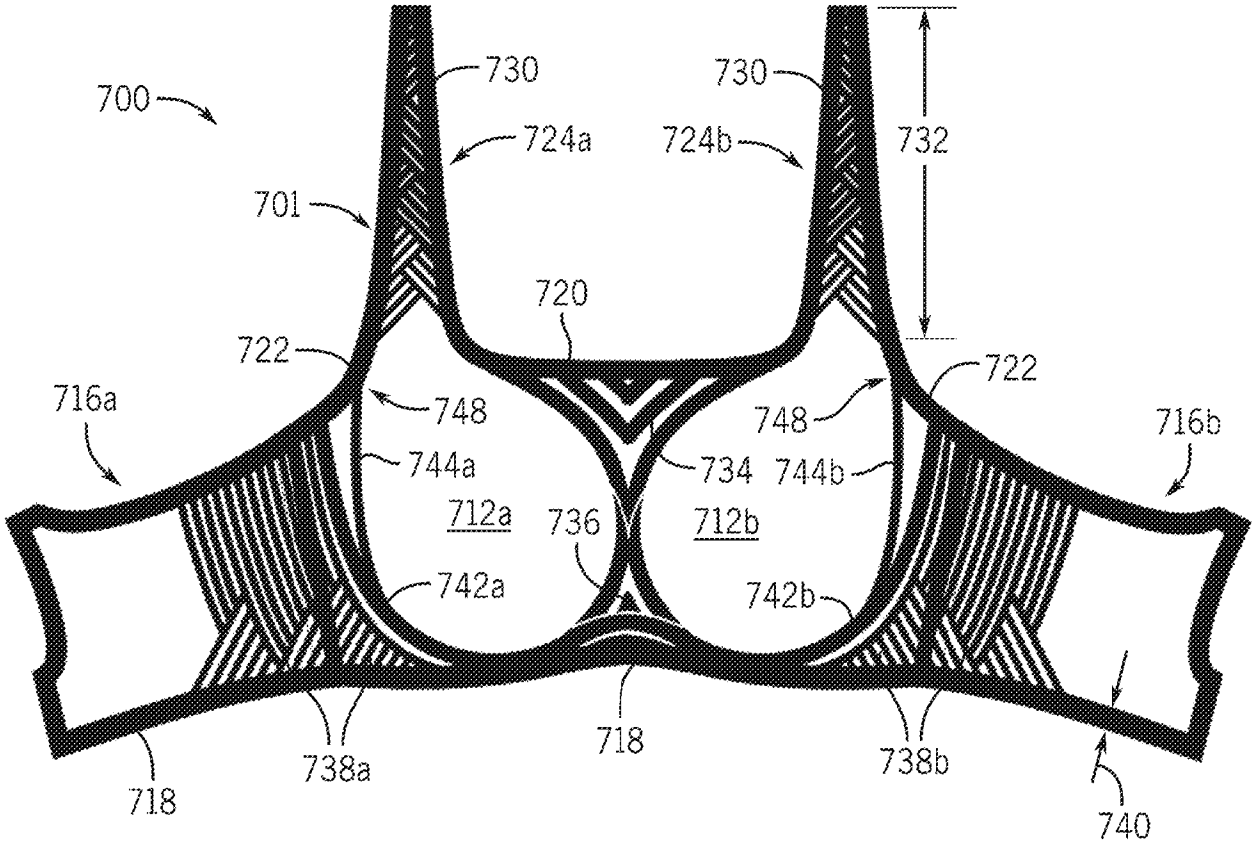
FIG. 7 illustrates an exemplary printed reinforcement layer for another set of bras having a third level of support.

FIGS. 5-7 depict further exemplary patterns for the printed reinforcement layers 501, 601, 701 that may be printed directly on either the outer face of the inner layer 30 or the inner face of the outer layer 28 to form a collection of bras 500, 600, 700 according to the present disclosure. The printed reinforcement layers 501, 601, 701 are shown to be provided in various locations on the bras 500, 600, 700. In an exemplary embodiment, strap reinforcements 530, 630, 730 may be printed within the straps of the bras (i.e., 524*a*, 524*b* of FIG. 5; 624*a*, 624*b* of FIG. 6; 724*a*, 724*b* of FIG. 7.). Underbust reinforcements 542*a*, 542*b* may be provided at the lower and outer edges of cups 512*a*, 512*b*, respectively; underbust reinforcements 642*a*, 642*b* may be provided at the lower and outer edges of cup regions 612*a*, 612*b*, respectively; and underbust reinforcements 742*a*, 742*b* may be provided at the lower and outer edges of cup regions 712*a*, 712*b*, respectively. The underbust reinforcements 542*a*, 542*b*, 642*a*, 642*b*, 742*a*, 742*b* work to support the wearer's breasts against the force of gravity, serving the function of a traditional underwire. Upper and lower middle reinforcements 534, 536, 634, 636, 734, 736 may be printed between the cup regions (i.e., between 512*a* and 512*b* of FIG. 5; between 612*a* and 612*b* of FIG. 6, between 712*a* and 712*b* of FIG. 7), and wing reinforcements 538*a*, 538*b*, 638*a*, 638*b*, 738*a*, 738*b* may be printed on at least a portion of the wings (i.e., 516*a*, 516*b* of FIG. 5; 616*a*, 616*b* of FIG. 6; 716*a*, 716*b* of FIG. 7). As shown, the surface area consumed by the printed reinforcement material for the upper and lower middle reinforcements 534, 536 in the level 1 bra is less than the surface area of upper and lower middle reinforcements 634, 636 of the level 2 bra, which is less than the surface area of upper and lower middle reinforcements 734, 736 of the level 3 bra. A similar pattern is shown in the wings 516*a*, 516*b*, 616*a*, 616*b*, and 716*a*, 716*b*: the level 1 bra contains no reinforcements that are positioned on a wearer's back when the bra 500 is worn (i.e., the wing reinforcements 538*a*, 538*b* are only in what might be considered the cradle area); the level 2 bra features a smaller surface area that is consumed by the wing reinforcements 638*a*, 638*b*, which in this case do extend to the wearer's back when the bra 600 is worn; and the level 3 bra features a larger surface area that is consumed by the wing reinforcements 738*a*, 738*b*, which also extend to the wearer's back when the bra 700 is worn. In addition, perimeter reinforcements are shown to be included along the bottom edges 518, 618, 718, neckline edges 520, 620, 720 and underarm edges 522, 622, 722. The perimeter reinforcements are shown to have generally consistent thicknesses 540, 640, 740, and may further function to ensure the outer and inner layers 28, 30 are properly adhered to each other.

Variations in the application of the reinforcement material between the level 1 (see FIG. 5), level 2 (see FIG. 6) and level 3 (see FIG. 7) bras result in differing levels of support provided to a wearer's breasts. For example, the length 532 of the strap reinforcements 530 of the level 1 bra is shorter than the length 632 of the strap reinforcements 630 of the level 2 bra, which in turn is shorter than the length 732 of the strap reinforcements 730 of the level 3 bra. Increasing the length of the strap reinforcements decreases the amount that the straps can stretch due to forces exerted by the wearer's breasts on the straps in the direction of gravity. In addition, as shown in FIGS. 6 and 7, the cup regions 612*a*, 612*b*, 712*a*, 712*b* may further include cup reinforcements 644*a*, 644*b*, 744*a*, 744*b* that extend from the bottom edges 618, 718 to the underarm edges 622, 722. More specifically, the cup reinforcements 744*a*, 744*b* in the level 3 bra 700 of FIG. 7 extend upwardly from the underbust reinforcements 742*a*, 742*b* and connect tangentially to the perimeter reinforcements on the straps 724*a*, 724*b* at locations 748. Because the underbust reinforcements 742*a*, 742*b* are situated below the wearer's breasts when the bra 700 is worn, this connection provided by the cup reinforcements 744*a*, 744*b* allows the weight of the wearer's breasts to be directly longitudinally supported by the reinforcement material provided along the length of the straps 724*a*, 724*b*. In contrast, the cup reinforcements 644*a*, 644*b* in the level 2 bra 600 of FIG. 6 connect to the perimeter reinforcements further laterally outward along the underarm edges 622, at locations 650, rather than tangentially to the perimeter reinforcements in the straps 624*a*, 624*b*. Thus, the level 2 bra 600 provides less direct shoulder-to-underbust support than the level 3 bra 700. The cup reinforcements 644*a*, 644*b* do still provide support to the level 2 bra 600 in comparison to the level 1 bra 500 in that they extend upwardly from the underbust reinforcements 642*a*, 642*b* and provide an extra point of connection to the perimeter reinforcements.

The overall amount of printed reinforcement material applied to the bras may further affect the amount of support provided to a wearer's breasts. For example, the level 1 bras 100, 500 may comprise "low build" silicone, the level 2 bras 200, 600 may comprise "high build" silicone, and the level 3 bras 300, 700 may comprise "mid build" silicone. "Build" in this instance refers to the height of the silicone from the face of the fabric onto which it is applied. In one example, "low build" silicone has a weight of 160-200 grams per square meter (gsm), "mid build" silicone has a weight of 360-400 gsm, and "high build" silicone has a weight of 450-490 gsm. In other words, the amount of printed material used in the level 1 bra may be less than the amount of printed material used in the level 3 bra, which may in turn be less than the amount of printed material used in the level 2 bra. Although it may seem counterintuitive that the higher support level 3 bra includes less printed reinforcement material than the medium support level 2 bra, the present inventors have recognized that when the microfiber material weights are as provided above (i.e., about 150 gsm for level 1, about 190 gsm for level 2, and about 220 gsm for level 3), the combinations of lower material weight and higher silicone build in level 2 and higher material weight and lower silicone build in level 3 result in desired support levels. In one particular example, a level 1 bra is made of microfiber material having a weight of 150 gsm, and application of low build silicone having a weight of 160-200 gsm results in a front panel for the bra having a modulus of 0.821 lbf (LTD06 at 40% stretch). In one particular example, a level 2 bra is made of microfiber material having a weight of 190 gsm, and application of high build silicone having a weight of 450-490 gsm results in a front panel for the bra having a modulus of 1.079 lbf (LTD06 at 40% stretch). In one particular example, a level 3 bra is made of microfiber material having a weight of 220 gsm, and application of mid build silicone having a weight of 360-400 gsm results in a front panel for the bra having a modulus of 1.180 lbf (LTD06 at 40% stretch). In some examples, a highest material weight and a highest silicone build may be used together to create a bra with more support than that of the level 3 bra (i.e., a level 4 bra). In general, the desired support for a given level of bra is achieved through a combination of fabric weight and modulus, reinforcement layer build, and reinforcement layer placement and coverage.

Figure 8A:
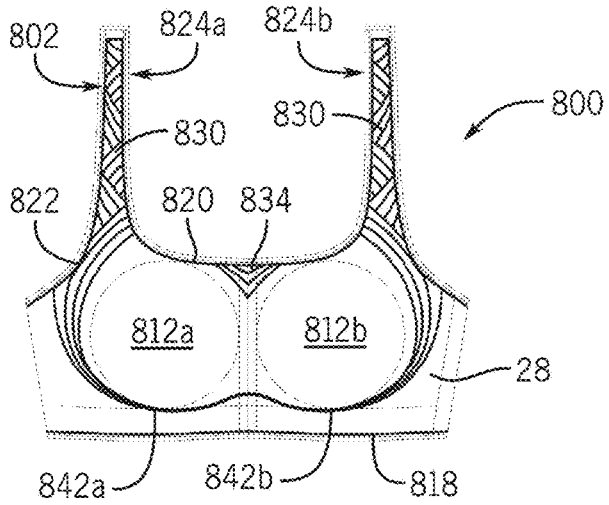
FIG. 8A illustrates an exemplary printed reinforcement layer printed on an outer layer of another set of bras having a first level of support.
Figure 9A:
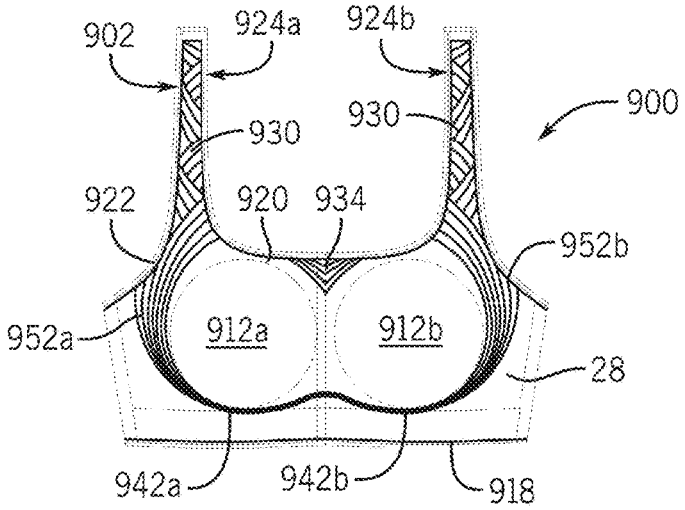
FIG. 9A illustrates an exemplary printed reinforcement layer printed on an outer layer of another set of bras having a second level of support.
Figure 10A:
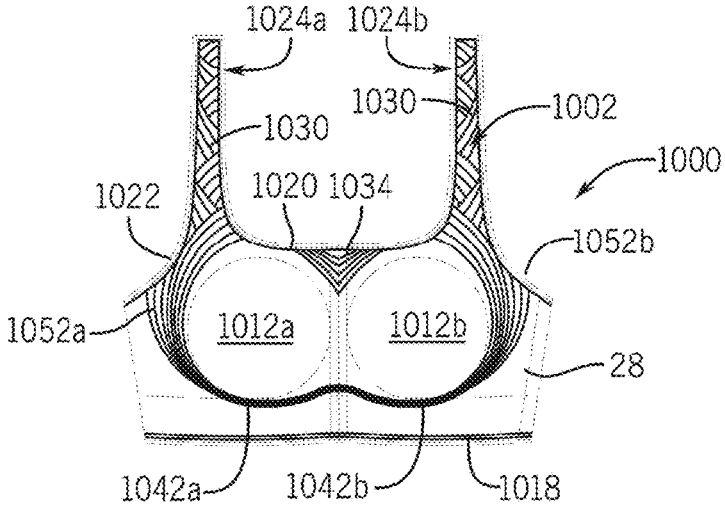
FIG. 10A illustrates an exemplary printed reinforcement layer printed on an outer layer of another set of bras having a third level of support.
Figure 8B:
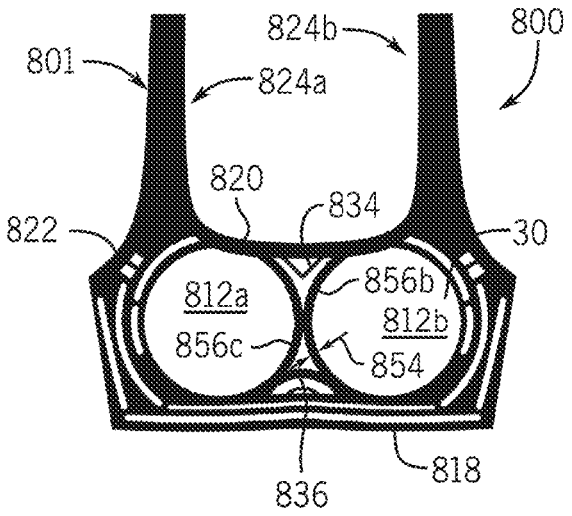
FIG. 8B illustrates an exemplary printed reinforcement layer printed on an inner layer of the set of bras of FIG. 8A.
Figure 9B:
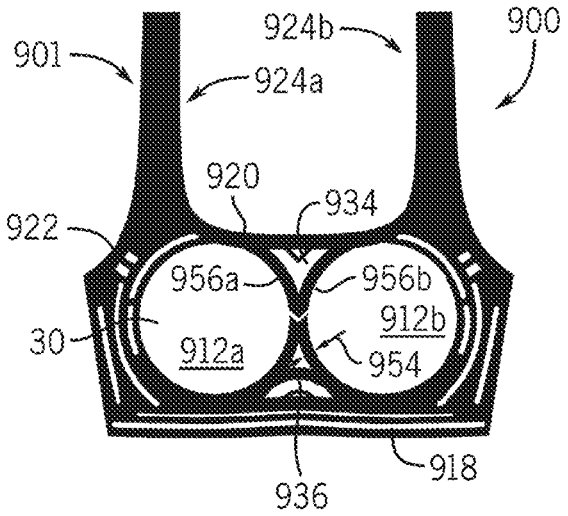
FIG. 9B illustrates an exemplary printed reinforcement layer printed on an inner layer of the set of bras of FIG. 9A.
Figure 10B:
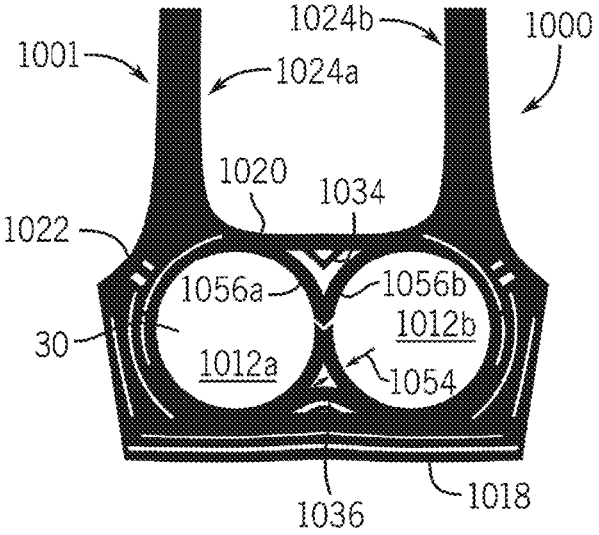
FIG. 10B illustrates an exemplary printed reinforcement layer printed on an inner layer of the set of bras of FIG. 10A.
Figure 8C:
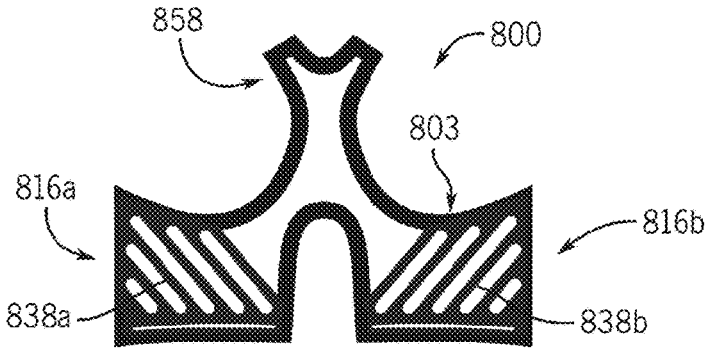
FIG. 8C illustrates an exemplary printed reinforcement layer printed on a back panel of the set of bras of FIG. 8A.
Figure 9C:
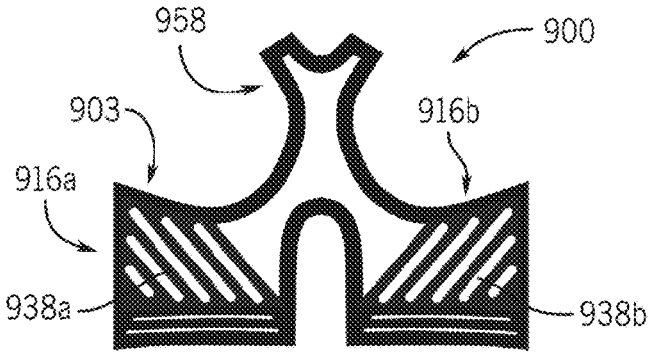
FIG. 9C illustrates an exemplary printed reinforcement layer printed on a back panel of the set of bras of FIG. 9A.
Figure 10C:
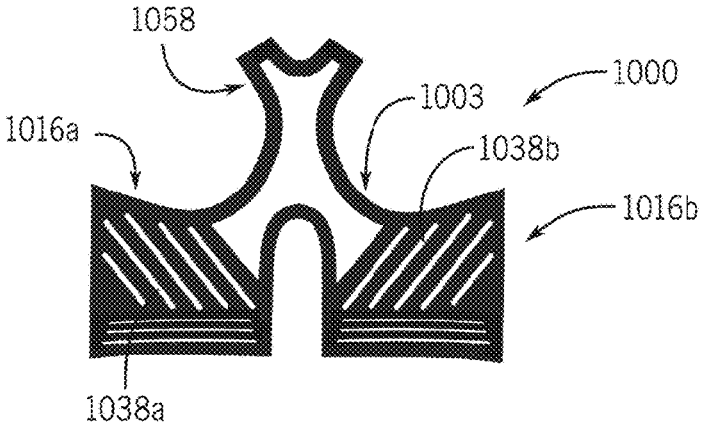
FIG. 10C illustrates an exemplary printed reinforcement layer printed on a back panel of the set of bras of FIG. 10A.

FIGS. 8A-10C show the layers of yet another exemplary collection of bras 800, 900, 1000 according to the present disclosure. FIGS. 8A, 9A, and 10A show reinforcement layers 802, 902, 1002 that may be printed on the outer face of the outer layer 28 of a given bra; FIGS. 8B, 9B, and 10B show reinforcement layers 801, 901, 1001 that may be printed on the outer face of the inner layer 30 or the inner face of the outer layer 28 of the front panel of a given bra; and FIGS. 8C, 9C, and 10C show reinforcement layers 803, 903, 1003 that may be printed on the outer face of the inner layer 30 or the inner face of the outer layer 28 of the back panel of a given bra. FIGS. 8A-C show the layers of a level 1 bra, FIGS. 9A-C show the layers of a level 2 bra, and FIGS. 10A-C show the layers of a level 3 bra.

As shown in FIGS. 8A, 9A, and 10A, the printed reinforcement layers on the outer face of the outer layer 28 of the bras 800, 900, 1000 are shown to be provided in various locations. The reinforcements may be printed silicone, which may be flocked to provide a desired feel and/or aesthetic. In an exemplary embodiment, strap reinforcements 830, 930, 1030 may be printed within the straps of the bras (i.e., 824*a*, 824*b* of FIG. 8; 924*a*, 924*b* of FIG. 9; 1024*a*, 1024*b* of FIG. 10.). Underbust reinforcements 842*a*, 842*b* may be provided at the lower and outer edges of cups 812*a*, 812*b*, respectively; underbust reinforcements 942*a*, 942*b* may be provided at the lower and outer edges of cups 912*a*, 912*b*, respectively; and underbust reinforcements

1042*a*, 1042*b* may be provided at the lower and outer edges of cups 1012*a*, 1012*b*, respectively. The underbust reinforcements work to support the wearer's breasts against the force of gravity, serving the function of a traditional underwire. Upper middle reinforcements 834, 934, 1034 may be printed between the cup regions (i.e., between 812*a* and 812*b* of FIG. 8; between 912*a* and 912*b* of FIG. 9, between 1012*a* and 1012*b* of FIG. 10). As shown, the surface area consumed by the printed reinforcement material for the upper middle reinforcements 834 in the level 1 bra is less than the surface area of upper middle reinforcements 934 of the level 2 bra, which is less than the surface area of upper middle reinforcements 1034 of the level 3 bra. Perimeter reinforcements are shown to be included along the bottom edges 818, 918, 1018, neckline edges 820, 920, 1020 and underarm edges 822, 922, 1022. In addition, as shown in FIGS. 9 and 10, outer lateral reinforcements 952*a*, 952*b* and 1052*a*, 1052*b* are provided laterally outwardly of each of the cups 912*a*, 912*b* and 1012*a*, 1012*b*. These outer lateral reinforcements 952*a*, 952*b* and 1052*a*, 1052*b* join with the underbust reinforcements 942*a*, 942*b* and 1042*a*, 1042*b* and connect to the peripheral reinforcements at the underarm edges 922, 1022 to provide additional support for the breasts against the forces of gravity.

As shown in FIGS. 8B, 9B, and 10B, the printed reinforcement layers on the outer face of the inner layer 30 (or, in another example, the inner face of the outer layer 28) of front panels of the bras 800, 900, 1000 are shown to be provided in various configurations. The reinforcement layers in the straps 824*a*, 824*b*, 924*a*, 924*b*, 1024*a*, 1024*b* are applied in a solid layer over the entire strap. The neckline edges 820, 920, 1020 and bottom edges 818, 918, 1018 include perimeter reinforcements that bond the outer and inner layers 28, 30 together. The underarm edges 822, 922, 1022 are also provided with perimeter reinforcements, which extend inwardly toward the cups. The reinforcement layers in each bra are broken by the presence of gaps in the reinforcement material, which gap provide breathability and flexibility to the bras 800, 900, 1000. The surface area covered by the reinforcement layer in the level 1 bra 800 is the least, as shown by, for example, the width 854 of perimetral cup reinforcements 856*a*, 856*b* being less than the width 954 of the perimetral cup reinforcements 956*a*, 956*b* in the level 2 bra 900, which in turn is less than the width 1054 of the perimetral cup reinforcements 1056*a*, 1056*b* of the level 3 bra 1000. The same holds true for the upper and lower middle reinforcements 834, 836, 934, 936, 1034, 1036, which cover increasing surface area as they move from level 1 to level 3.

As shown in FIGS. 8C, 9C, and 10C, the printed reinforcement layers on the outer face of the inner layer 30 (or, in another example, the inner face of the outer layer 28) of the back panels of the bras 800, 900, 1000 are shown to be provided in various configurations. Each back panel includes perimeter reinforcements along the racerback 858, 958, 1058 (to which the straps are to be attached) and along the top and bottom edges of the wings 816*a*, 816*b*, 916*a*, 916*b*, 1016*a*, 1016*b*. Wing reinforcements 838*a*, 838*b*, 938*a*, 938*b*, 1038*a*, 1038*b* are provided on each of the wings. The level 1 bra 800 has the widest gaps provided in the wing reinforcements 838*a*, 838*b*, the level 2 bra 900 has narrower gaps in the wing reinforcements 938*a*, 938*b*, and the level 3 bra has the narrowest gaps in the wing reinforcements 1038*a*, 1038*b*.

As with the examples of FIGS. 2A-7, the overall amount of printed reinforcement material applied to the bras 800, 900, 1000 may further affect the amount of support provided to a wearer's breasts. For example, the level 1 bras 800 may comprise "low build" silicone, the level 2 bra 900 may comprise "high build" silicone, and the level 3 bra 1000 may comprise "mid build" silicone.

A level 1 bra may be lightweight, may provide subtle lift to the wearer's breasts, and may provide minimal coverage over the wearer's breasts in comparison to a level 2 or level 3 bra. A level 2 bra may provide enhanced lift and definition to the wearer's breasts in comparison to a level 1 bra by virtue of the greater amount of printed material and higher material weight in a level 2 versus a level 1 bra, and may provide separation of the wearer's breasts by virtue of the laterally wider coverage of the printed material at upper and lower middle reinforcements 234, 236 in a level 2 bra than at upper and lower middle reinforcements 134, 136 in a level 1 bra. A level 3 bra may provide smoothing, sculpting, and bounce control by virtue of the greater amount of printed material in a level 3 versus a level 1 bra and a higher material weight than in a level 2 or level 1 bra, as well as full coverage over the wearer's breast tissue.

Figure 11:
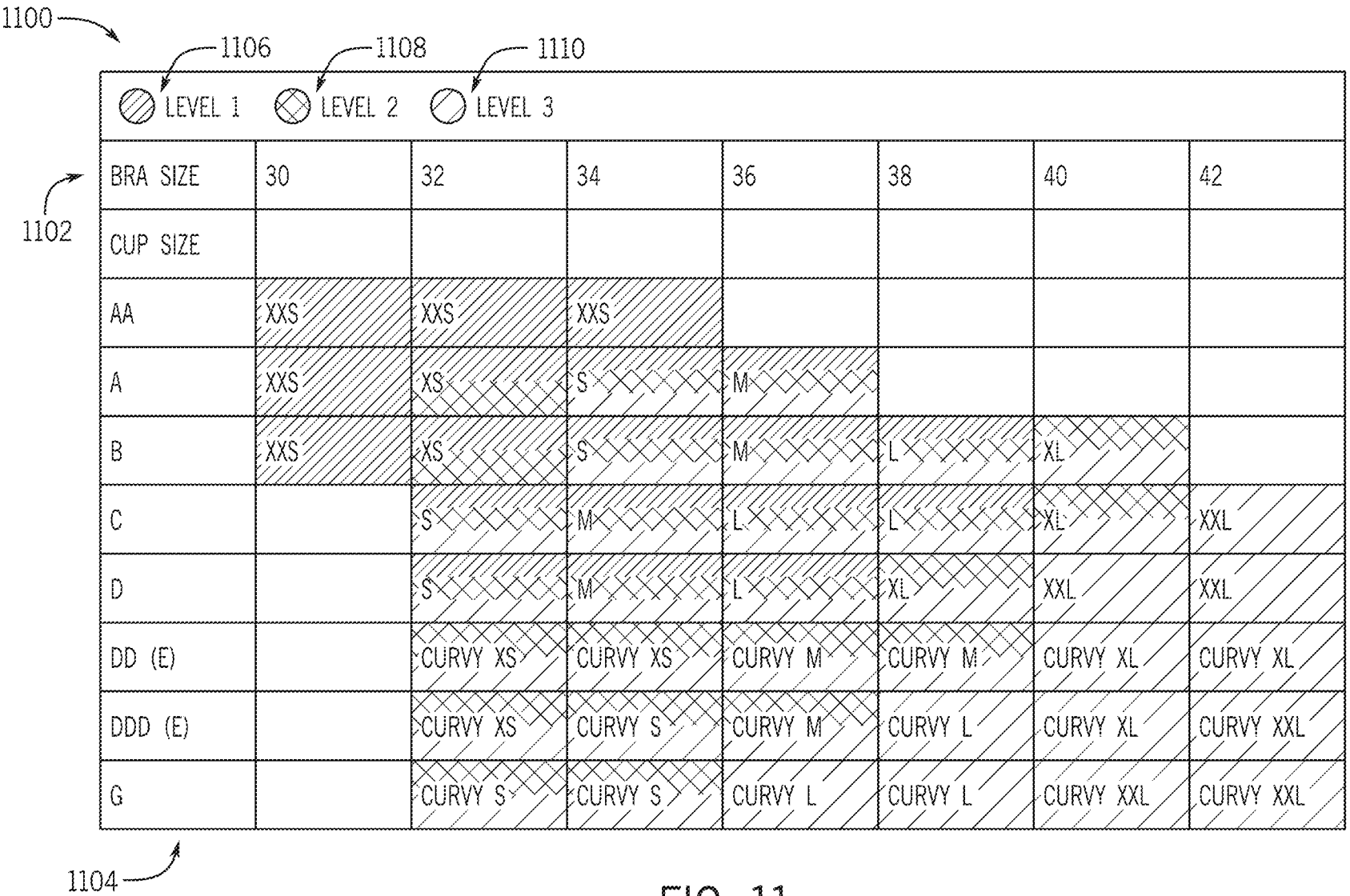
FIG. 11 illustrates an exemplary table corresponding bra cup and bra band sizes to levels of support for sets of bras in the collection of bras of FIG. 1.

Turning now to FIG. 11, an exemplary table 1100 is shown that depicts a correlation between bra band size (shown in horizontal row 1102), bra cup size (shown in vertical row 1104), and availability of bra sets providing level 1 support (shown using shading pattern 1106), level 2 support (shown using shading pattern 1108), and level 3 support (shown using shading pattern 1110). As noted, the bra 10 is one of a collection of bras. In other words, there are various bras having similar construction and style as part of the collection, but which are provided in various band and cup sizes. The exemplary collection of bras includes at least a first set of bras providing level 1 support comprising at least a first set of bra cup sizes AA-D and bra band sizes 30-38 (see shading pattern 1106), a second set of bras comprising at least a second set of bra cup sizes A-G and bra band sizes 32-40 (see shading pattern 1108), and a third set of bras comprising at least a third set of bra cup sizes A-G and bra band sizes 32-42 (see shading pattern 1110). As noted above, "cup size" is not intended to refer to the true size (e.g., dimensions or volume) of the bra cup regions 12*a*, 12*b*, but rather to the alphabetical size of the bra cup as per the discussion of bra sizing provided hereinabove. As shown, exemplary possible tag sizes (i.e., the size that is shown on the tag of the bra) for the collection of bras disclosed herein range from XXS (extra-extra small) for the smallest band and cup sizes, and Curvy XXL (extra-extra large) for the largest band and cup sizes. Although not all sizes are intended to be available in the collection of bras in all three support levels, the majority of combinations of band and cup sizes are provided in at least two support levels (e.g., size L (large) is provided in level 1, level 2, and level 3 for band/cup size combinations 36C, 36D, 38B, and 38C). Notably, both wearers who are size 34A and wearers who are size 36D have choices among all three levels of support, which is not typically the case with traditionally designed bras. Typically, a wearer who is size 34A will be provided only with a low-support option, while a wearer who is size 36D will be provided only with a high support option. The present collection of bras therefore provides wearers—even wearers at the ends of the size spectrum—with a plurality of support level options depending on their personal preference and/or tissue type.

Note that the number of levels disclosed herein is merely exemplary, and other collections of bras containing different numbers of levels (e.g., four levels or support or more) are contemplated within the scope of the present disclosure and may be achieved by varying the characteristics of the inner and outer material layers, as well as the printed reinforcement layer. Nor is the present invention limited to bras. In other embodiments, the techniques disclosed herein may be utilized to fabricate a variety of garments, including undergarments. For example, underwear and shapewear garments (e.g., bike shorts, body suits, tanks) could incorporate printed reinforcement layers in regions where additional support to the wearer's body is desired (e.g., waist region, leg region).

Examples

According to one example of the present disclosure, a collection of bras 100, 200, 300, 500, 600, 700, 800, 900, 1000 comprises a first set of bras 100, 500, 800 configured to provide a first level of support to breast tissue. Each of the bras in the first set of bras includes a first inner layer 30, a first outer layer 28, and a first printed reinforcement layer 101, 501, 801 positioned between the first inner layer 30 and the first outer layer 28. The collection of bras further comprises a second set of bras 200, 600, 900 configured to provide a second level of support to breast tissue. Each of the bras in the second set of bras includes a second inner layer 30, a second outer layer 28, and a second printed reinforcement layer 201, 601, 901 positioned between the second inner layer 30 and the second outer layer 28. A material weight of the first inner layer 30 and the first outer layer 28 is less than a material weight of the second inner layer 30 and the second outer layer 28, an amount of printed material comprising the first printed reinforcement layer 101, 501, 801 is less than an amount of printed material comprising the second printed reinforcement layer 201, 601, 901, and the first level of support is less than the second level of support.

According to one aspect, the first inner layer 30, the first outer layer 28, the second inner layer 30, and the second outer layer 28 each comprise a microfiber material.

According to one aspect, the first printed reinforcement layer 101, 501, 801 and the second printed reinforcement layer 201, 601, 901 each comprise a silicone material.

According to one aspect, the material weight of the first inner layer 30 and the first outer layer 28 is about 150 grams per square meter, and the material weight of the second inner layer 30 and the second outer layer 28 is about 190 grams per square meter.

According to one aspect, the first set of bras 100, 500, 800 comprises bras having a first set of bra cup sizes, the second set of bras 200, 600, 900 comprises bras having a second set of bra cup sizes, and the first set of bra cup sizes is different from the second set of bra cup sizes.

According to one aspect, the collection of bras further comprises a third set of bras 300, 700, 1000 configured to provide a third level of support to breast tissue. Each of the bras in the third set of bras comprises a third inner layer 30, a third outer layer 28, and a third printed reinforcement layer 301, 701, 1001 positioned between the third inner layer 30 and the third outer layer 28. The third level of support is greater than the first level of support and the second level of support.

According to one aspect, a material weight of the third inner layer 30 and the third outer layer 28 is greater than a material weight of the first inner layer 30, the first outer layer 28, the second inner layer 30, and the second outer layer 28.

According to one aspect, an amount of printed material comprising the third printed reinforcement layer 301, 701, 1001 is greater than an amount of printed material comprising the first printed reinforcement layer 101, 501, 801.

According to one aspect, an amount of printed material comprising the third printed reinforcement layer 301, 701, 1001 is less than an amount of printed material comprising the second printed reinforcement layer 201, 601, 901.

According to one aspect, the material weight of the first inner layer 30 and the first outer layer 28 is about 150 grams per square meter, the material weight of the second inner layer 30 and the second outer layer 28 is about 190 grams per square meter, and the material weight of the third inner layer 30 and the third outer layer 28 is about 220 grams per square meter.

According to one example, the first set of bras 100, 500, 800 comprises bras having a first set of bra cup sizes, the second set of bras 200, 600, 900 comprises bras having a second set of bra cup sizes, the third set of bras 300, 700, 1000 comprises bras having a third set of bra cup sizes, and the third set of bra cup sizes is different from at least one of the first set of bra cup sizes and the second set of bra cup sizes.

According to another example of the present disclosure, a collection of undergarments is provided. The collection of undergarments comprises a plurality of sets of undergarments, wherein each set in the plurality of sets is configured to provide a corresponding level of support to a wearer's body, and wherein each undergarment in the plurality of sets comprises an inner layer 30, an outer layer 28, and a printed reinforcement layer 101, 201, 301, 501, 601, 701, 801, 901, 1001 bonding the inner layer to the outer layer. At least one of the following conditions is satisfied in the collection of undergarments: a material weight of the inner layer 30 and the outer layer 28 of each undergarment in one set of the plurality of sets is different from a material weight of the inner layer 30 and the outer layer 28 of each undergarment in every other set in the plurality of sets; and an amount of printed material comprising the printed reinforcement layer 101, 201, 301, 501, 601, 701, 801, 901, 1001 of each undergarment in one set of the plurality of sets is different from an amount of printed material comprising the printed reinforcement layer 101, 201, 301, 501, 601, 701, 801, 901, 1001 of each undergarment in every other set in the plurality of sets.

According to one example, the inner layer 30 and the outer layer 28 each comprise a microfiber material.

According to one example, the printed reinforcement layer 101, 201, 301, 501, 601, 701, 801, 901, 1001 comprises a silicone material.

According to one example, each undergarment in the plurality of sets is a bra 100, 200, 300, 500, 600, 700, 800, 900, 1000.

According to one example, each bra 100, 200, 300, 500, 600, 700, 800, 900, 1000 comprises a pair of bra cup regions, and printed material of the printed reinforcement layer is located between the pair of bra cup regions.

According to one example, each bra comprises a pair of bra cup regions 112*a/b*, 212*a/b*, 312*a/b*, 512*a/b*, 612*a/b*, 712*a/b*, 812*a/b* 912*a/b*, 1012*a/b*, and printed material of the printed reinforcement layer 101, 201, 301, 501, 601, 701, 801, 901, 1001 is located underneath the pair of bra cup regions.

According to one example, each bra 100, 200, 300, 500, 600, 700, 800, 900, 1000 comprises a pair of straps 124*a/b*, 224*a/b*, 324*a/b*, 524*a/b*, 624*a/b*, 724*a/b*, 824*a/b*, 924*a/b*, 1024*a/b*, and printed material of the printed reinforcement layer 101, 201, 301, 501, 601, 701, 801, 901, 1001 is located within at least a portion of each strap in the pair of straps.

According to one example, the plurality of sets of undergarments comprises a first set of bras 100, 500, 800 associated with a first set of bra cup sizes and a second set of bras 200, 600, 900 associated with a second set of bra cup sizes, and the first set of bra cup sizes is different from the second set of bra cup sizes.

According to one example, a difference between the material weight of the inner layer 30 and the outer layer 28 of each bra in the first set of bras 100, 500, 800 and the material weight of the inner layer 30 and the outer layer 28 of each bra in the second set of bras 200, 600, 900 is at least 30 grams per square meter.

In the present description, certain terms have been used for brevity, clarity, and understanding. No unnecessary limitations are to be implied therefrom beyond the requirement of the prior art because such terms are used for descriptive purposes only and are intended to be broadly construed. The different assemblies described herein may be used alone or in combination with other systems. Various equivalents, alternatives, and modifications are possible within the scope of the appended claims.

What is claimed is:

1. A collection of bras comprising:

a first set of bras configured to provide a first level of support to breast tissue of a human wearer, each of the bras in the first set of bras comprising a first inner layer, a first outer layer, and a first printed reinforcement layer printed on one of the first inner layer and the first outer layer and positioned between the first inner layer and the first outer layer, wherein the first inner layer, first printed reinforcement layer, and first outer layer together provide the first level of support; and a second set of bras configured to provide a second level of support to the breast tissue of the human wearer, each of the bras in the second set of bras comprising a second inner layer, a second outer layer, and a second printed reinforcement layer printed on one of the second inner layer and the second outer layer and positioned between the second inner layer and the second outer layer, wherein the second inner layer, second printed reinforcement layer, and second outer layer together provide the second level of support;

wherein a material weight of the first inner layer and the first outer layer is less than a material weight of the second inner layer and the second outer layer;

wherein an amount of printed material constituting the first printed reinforcement layer is less than an amount of printed material constituting the second printed reinforcement layer; and wherein the first level of support is less than the second level of support.

2. The collection of bras of claim 1, wherein the first inner layer, the first outer layer, the second inner layer, and the second outer layer each comprise a microfiber material.

3. The collection of bras of claim 1, wherein the printed material constituting the first printed reinforcement layer comprises silicone and the printed material constituting the second printed reinforcement layer comprises silicone.

4. The collection of bras of claim 1, wherein:

the material weight of the first inner layer is about 150 grams per square meter and the material weight of the first outer layer is about 150 grams per square meter; and the material weight of the second inner layer is about 190 grams per square meter and the material weight of the second outer layer is about 190 grams per square meter.

5. The collection of bras of claim 1, wherein:

the first set of bras comprises bras having a first set of bra cup sizes;

the second set of bras comprises bras having a second set of bra cup sizes; and the first set of bra cup sizes is different from the second set of bra cup sizes.

6. The collection of bras of claim 1, further comprising:

a third set of bras configured to provide a third level of support to the breast tissue of the human wearer, each of the bras in the third set of bras comprising a third inner layer, a third outer layer, and a third printed reinforcement layer printed on one of the third inner layer and the third outer layer and positioned between the third inner layer and the third outer layer, wherein the third inner layer, third printed reinforcement layer, and third outer layer together provide the third level of support;

wherein the third level of support is greater than the first level of support and the second level of support.

7. The collection of bras of claim 6, wherein a material weight of the third inner layer and the third outer layer is greater than a material weight of the first inner layer, the first outer layer, the second inner layer, and the second outer layer.

8. The collection of bras of claim 6, wherein an amount of printed material constituting the third printed reinforcement layer is greater than an amount of printed material constituting the first printed reinforcement layer.

9. The collection of bras of claim 6, wherein an amount of printed material constituting the third printed reinforcement layer is less than an amount of printed material constituting the second printed reinforcement layer.

10. The collection of bras of claim 6, wherein:

the material weight of the first inner layer is about 150 grams per square meter and the material weight of the first outer layer is about 150 grams per square meter;

the material weight of the second inner layer is about 190 grams per square meter and the material weight of the second outer layer is about 190 grams per square meter; and a material weight of the third inner layer is about 220 grams per square meter and the material weight of the third outer layer is about 220 grams per square meter.

11. The collection of bras of claim 6, wherein:

the first set of bras comprises bras having a first set of bra cup sizes;

the second set of bras comprises bras having a second set of bra cup sizes;

the third set of bras comprises bras having a third set of bra cup sizes; and the third set of bra cup sizes is different from at least one of the first set of bra cup sizes and the second set of bra cup sizes.

12. A collection of upper torso undergarments comprising:

a plurality of sets of upper torso undergarments, wherein each set in the plurality of sets is configured to provide a corresponding level of support to a wearer's upper torso, and wherein each undergarment in the plurality of sets comprises an inner layer, an outer layer, and a printed reinforcement layer printed on one of the inner layer and the outer layer and bonding the inner layer to the outer layer, wherein the inner layer, printed reinforcement layer, and outer layer together provide the corresponding level of support to the wearer's upper torso;

wherein at least one of the following conditions is satisfied:

a material weight of the inner layer and the outer layer of each upper torso undergarment in one set of the plurality of sets is different from a material weight of the inner layer and the outer layer of each upper torso undergarment in every other set in the plurality of sets; and an amount of printed material constituting the printed reinforcement layer of each upper torso undergarment in one set of the plurality of sets is different from an amount of printed material constituting the printed reinforcement layer of each upper torso undergarment in every other set in the plurality of sets.

13. The collection of upper torso undergarments of claim 12, wherein the inner layer and the outer layer each comprise a microfiber material.

14. The collection of upper torso undergarments of claim 12, wherein the printed material constituting the printed reinforcement layer comprises silicone.

15. The collection of upper torso undergarments of claim 12, wherein each upper torso undergarment in the plurality of sets is a bra.

16. The collection of upper torso undergarments of claim 15, wherein each bra comprises a pair of bra cup regions, and wherein the printed material of the printed reinforcement layer is located between the pair of bra cup regions.

17. The collection of upper torso undergarments of claim 15, wherein each bra comprises a pair of bra cup regions, and wherein the printed material of the printed reinforcement layer is located underneath the pair of bra cup regions.

18. The collection of upper torso undergarments of claim 15, wherein each bra comprises a pair of straps, and wherein the printed material of the printed reinforcement layer is located within at least a portion of each strap in the pair of straps.

19. The collection of upper torso undergarments of claim 15, wherein:

the plurality of sets of upper torso undergarments comprises a first set of bras associated with a first set of bra cup sizes and a second set of bras associated with a second set of bra cup sizes; and the first set of bra cup sizes is different from the second set of bra cup sizes.

20. The collection of upper torso undergarments of claim 19, wherein a difference between the material weight of the inner layer and the outer layer of each bra in the first set of bras and the material weight of the inner layer and the outer layer of each bra in the second set of bras is at least 30 grams per square meter.

* * * * *